US005746628A

United States Patent [19]

Yamamoto

[11] Patent Number: 5,746,628

[45] Date of Patent: May 5, 1998

[54] ENGAGING STRUCTURE OF A TERMINAL AND A CONNECTOR HOUSING

[75] Inventor: Masaya Yamamoto, Shizuoka-ken, Japan

[73] Assignee: Yasaki Corporation, Tokyo, Japan

[21] Appl. No.: 553,765

[22] Filed: Oct. 23, 1995

[30] Foreign Application Priority Data

Oct. 28, 1994 [JP] Japan ..... 6-265193

[51] Int. Cl.[6] ..... H01R 13/447

[52] U.S. Cl. ..... 439/752; 439/595; 439/862

[58] Field of Search ..... 439/752, 595, 439/862, 744, 597, 598, 599

[56] References Cited

U.S. PATENT DOCUMENTS

| | | | |
|---|---|---|---|
| 5,051,100 | 9/1991 | Kato et al. | 439/595 |
| 5,232,373 | 8/1993 | Sawada | 439/595 |

FOREIGN PATENT DOCUMENTS

| | | |
|---|---|---|
| 5-828 | 1/1993 | Japan . |
| 5-36778 | 5/1993 | Japan . |

*Primary Examiner*—P. Austin Bradley
*Assistant Examiner*—T. C. Patel
*Attorney, Agent, or Firm*—Finnegan, Henderson, Farabow, Garrett & Dunner, L.L.P.

[57] ABSTRACT

Engaging structure of a terminal and a connector housing comprises a contact piece 5 and an electric wire connecting portion 7, and can be inserted into a terminal receiving cavity 23 of a housing 22, which includes a retainer 28 provided with a detecting protrusion 57. The terminal 1 is provided with a projecting portion 9 which allows the retainer to be moved to the primary locking position, by slipping off from a moving path of the detecting protrusion 57 toward the front side B of a terminal insertion direction, when the retainer is at the provisional locking position and the terminal is completely inserted at the normal position, and which prevents the retainer 28 to be moved to the primary locking position, by abutting against the detecting protrusion 57, when the terminal 1 is incompletely inserted before the normal locking position. The projecting portion 9 is provided with a detection hole 73 for detecting faulty insertion of the terminal. The detection hole is engaged with the detecting protrusion 57 when the terminal 1 is inserted with the retainer 28 located at the primary locking position. Thereby, easy detection for falsely insertion of a terminal into a housing with a retainer locked at a primary locking position can be ensured.

3 Claims, 4 Drawing Sheets

ENGAGING STRUCTURE OF A TERMINAL AND A CONNECTOR HOUSING

BACKGROUND OF THE INVENTION

1. Field of the Invention

The present invention relates to the engaging structure of a terminal and a connector housing for ensuring the terminal is inserted completely.

2. Background of the Invention

A conventional engaging structure of terminals and a connector housing is described in Japanese Utility Model Publication (KOKAI) 5-36778.

This terminal is formed by pressing a metal sheet into a predetermined shape. The terminal comprises a contact piece folded back from the front end of a base plate toward a central portion thereof, an engaging hole arranged at the central portion of the base plate, an electric wire connecting portion arranged at the rear end of the base plate, and a projecting portion arranged between the contact piece and the connecting portion. The projecting portion comprises side plates folded along side edges of the base plate into upright positions, and an upper wall inwardly folded from the side plate. An electric wire is connected by caulking at the connecting portion.

A plastic connector housing is provided with a plurality of terminal receiving cavities. A top wall for the terminal receiving cavities has a cut out through which the terminal receiving cavities partially opens and from which the contact piece is exposed.

The housing is fitted with a cover and a retainer which are both made of plastic. A pair of side plates of the housing have slide grooves which face each other and slidably support the cover. At both outer sides of the housing, the retainer is slidable in a direction which intersects substantially perpendicularly to a terminal insertion direction.

The retainer have grooves for moving the cover within a pair of the side plates and a detecting protrusion projecting into the terminal receiving cavity in a horizontal plate. The projecting portion is arranged such that it contacts the detecting protrusion when the terminal is inserted completely and the retainer is locked at the primary locking position.

The grooves, arranged in the retainer for moving the cover, are arranged such that they are located on an axis coaxial with that of the slide groove of the housing when the retainer is located at the primary locking position and they cooperate with the slide groove to form a step when the retainer is located at the provisional locking position.

The retainer is locked at the provisional locking position, and the terminal is inserted into the terminal receiving cavity when using the connector. When the retainer moves to the primary locking position, the grooves arranged in the retainer for moving the cover are located on the axis coaxial with that of the slide grooves in the housing, and the detecting protrusion of the retainer comes into contact with the end edge of the projecting portion of the terminal to prevent the terminal from being withdrawn rearwardly.

When assembly of the connector is completed, and when the connector is mounted on the mating casing, the cover is slidably mounted to the grooves in the retainer arranged for moving the cover, thereby the upper portion of the cut out being opened. Thereafter, the housing is inserted into the receiving portion of the casing, while observing a contact piece of each terminal. Then electrical connection is established by making the contact piece of the terminal contact with a terminal of the casing.

If the terminal is not inserted completely, the retainer is prevented from moving to the primary locking position from the provisional locking position in spite of efforts to move, since the detecting protrusion abuts the upper wall of the projecting portion of the terminal. In this situation, a step is formed between the grooves arranged in the retainer for moving the cover and the slide groove in the housing so that the cover can not move towards the retainer. Thereby, an easy and firm detection of the incompletely inserted terminal is ensured.

In the conventional engaging structure of the terminal and the connector housing, if the retainer is locked at the primary locking position in a state where the terminal is not inserted, it is possible that the terminal is inserted to an extent that the electric wire connecting portion can not be seen from the outside because the metal terminal has elasticity and the plastic housing has flexibility when an operator inserts the terminal into the terminal receiving cavity without noticing this situation, then the terminal is inserted into and held in the terminal receiving cavity through faulty operation even before the terminal is completely inserted into the normal position. If the connector is mounted on the casing while the terminal is erroneously inserted in the incomplete state, a stable electric connection between the terminal of the connector and that of the casing may not be obtained. When the terminal of the connector is completely disconnected from that of the casing, it is possible to detect this disconnection at the time of inspecting an electric connection between the connector and the casing. However, it is troublesome to specify the erroneously inserted terminal when conducting the above inspection.

SUMMARY OF THE INVENTION

In view of the above problems, it is an object of the present invention to provide a engaging structure for terminals and a connector hausing which allows an easy and firm detection of terminals erroneously inserted into the housing with the retainer locked at the primary locking position.

This invention is a engaging structure for a terminal and connector housing comprising a contact piece formed at a front end side of a base plate and an electric wire connecting portion formed at a rear end side. The terminal inserts into a terminal receiving cavity of a housing from the front end of the base plate along a direction intersecting a moving direction of a retainer provided in the housing. The retainer moves between a provisional locking position and a primary locking position and locks at these positions. The retainer has a detecting protrusion protrudes into the terminal receiving cavity, the terminal has a projecting portion which allows the retainer to be moved to the primary locking position by slipping off from a moving path of the detecting protrusion toward the front side of a terminal insertion direction when the retainer is at the provisional locking position and the terminal is completely inserted at the normal position. This prevents the retainer from moving to the primary locking position because it buts against the detecting protrusion when the terminal is incompletely inserted just before the normal position. In said projecting portion there is a detection hole that engages the detecting protrusion when the terminal is inserted into the housing with the retainer located at the primary locking position.

According to the present invention, when the terminal is improperly inserted into the housing with the retainer locked at the primary locking position, the terminal can not be inserted further due to engagement of the detecting protrusion of the retainer with the detecting hole of the terminal at a predetermined insertion position. In other words, when the terminal is improperly inserted, an insertion of the terminal is firmly inhibited at a position where a predetermined amount of the connecting portion is exposed and it is possible to detect it at sight; thereby, when the terminal is inserted improperly, it is detected easily.

Moreover the present invention includes an engaging structure of a terminal and a connector housing having a protecting portion for protecting a contact piece arranged between the detection hole and the contact piece.

According to the present invention, a pulling force exerted on the terminal which is improperly inserted with the detecting protrusion engaged with the detection hole, will act on the contact piece protecting portion and the detecting protrusion will not press the contact piece. The result is that the contact piece is certainly prevented from deforming. When the terminal is pulled strongly in the case where a foreign substance is entrained to the detection hole before the terminal is inserted, such a strong force acts on the contact piece protecting portion, and the contact piece will not be pressed by the foreign substance. The result is that the contact piece is certainly prevented from being deformed.

Furthermore the present invention includes an engaging structure for a terminal and a connector housing having a reinforcing part for reinforcing the projecting portion that is arranged at an end edge of a rear side of the projecting portion in a terminal insertion direction.

According to the present invention, the projecting portion of the terminal is located more adjacent to the front side than to the detecting protrusion and prevents it from being withdrawn in the rear side of the terminal insertion direction, when the terminal is inserted completely at the normal position and the retainer is locked after it is moved from the provisional locking position to the primary locking position. As the projecting portion is reinforced by the reinforcing portion, deformation of the projecting portion is certainly prevented in spite of the presence of the detection hole, when the terminal is pulled strongly towards the rear side of the terminal insertion direction.

As explained above, according to the present invention when the terminal is improperly inserted into the housing with the retainer locked at the primary locking position, the insertion of the terminal is inhibited at a position where a predetermined amount of the connecting portion is exposed by engaging the detecting protrusion of the retainer with the detecting hole in the terminal. The result is that an improper insertion is detected easily, certainly and immediately one can then attempt to try an insertion again.

In addition to the effect of the present invention, the contact piece is certainly prevented from being deformed, because the contact piece protecting portion is provided.

In addition to the effect of the present invention, as the reinforcing portion for reinforcing the projecting portion is provided, deformation of the projecting portion is certainly prevented in spite of the presence of the detection hole, and withdrawal of the terminal is prevented certainly.

DETAILED DESCRIPTION OF THE PREFERRED EMBODIMENT

Now, an embodiment of the present invention will be described with reference to FIGS. 1 to 8 hereinafter.

Figure 1:
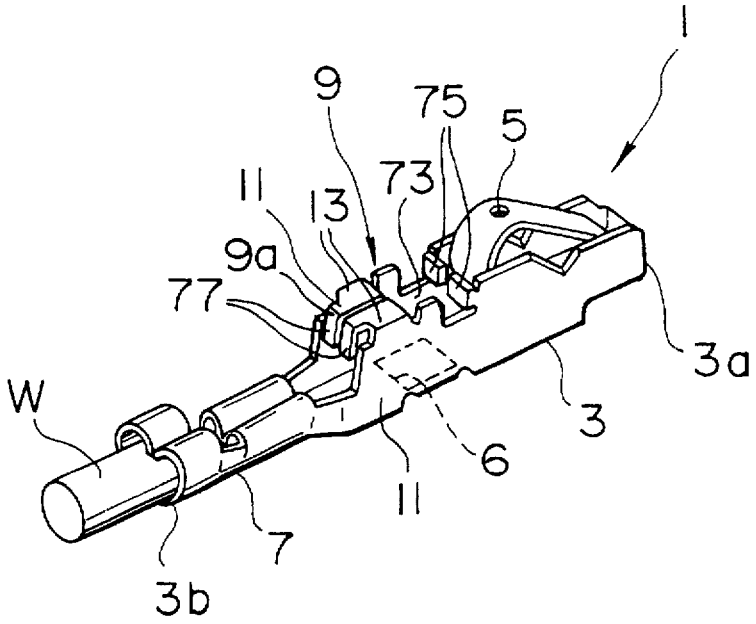
FIG. 1 is a perspective view of one embodiment of the terminal of the present invention.

As shown in FIG. 1, the terminal 1 according to an embodiment of the present invention is formed by pressing a metal sheet punched out into a predetermined shape. The terminal 1 comprises a contact piece 5 folded back from the front end of a base plate 3 toward a central portion thereof, an engaging hole 6 arranged at the central portion of the base plate 3, a electric wire connecting portion 7 arranged at the rear end 3*b* of the base plate 3, and a projecting portion 9 arranged between the contact piece 5 and the connecting portion 7. The projecting portion 9 comprises side plates 11 folded along side edges of the base plate 3 into upright positions, and upper walls 13 inwardly folded from the side plates 11. An electric wire W is connected by caulking at the connection portion 7.

The terminal 1 of the present embodiment has a detection hole 73 for detecting a faulty insertion. The detection hole 73 comprises an opening in the upper wall 13 at the projecting portion 9, and is engageable with a detecting protrusion 57 (described after herein) of a retainer 28. The distance between the detection hole 73 and the rear end 3*b* of the terminal 1 is set to be larger than the distance between the detecting protrusion 57 and a rear end A located at a rear end of a housing 22 in an insertion direction of the terminal. A predetermined amount of the connecting portion 7 in the terminal 1 is exposed to outside when the detecting protrusion 57 is engaged with the detection hole 73.

Provided between the detection hole 73 and the contact piece 5 are contact piece protecting portions 75 which are folded from the side plates 11 to protect the projecting portion 9. Also, provided at an edge 9*a* of a rear side of the projecting portion 9 in a terminal insertion direction is a reinforcing portion 77 which is folded from the upper wall 13 to reinforce the projecting portion 9.

Figure 2:
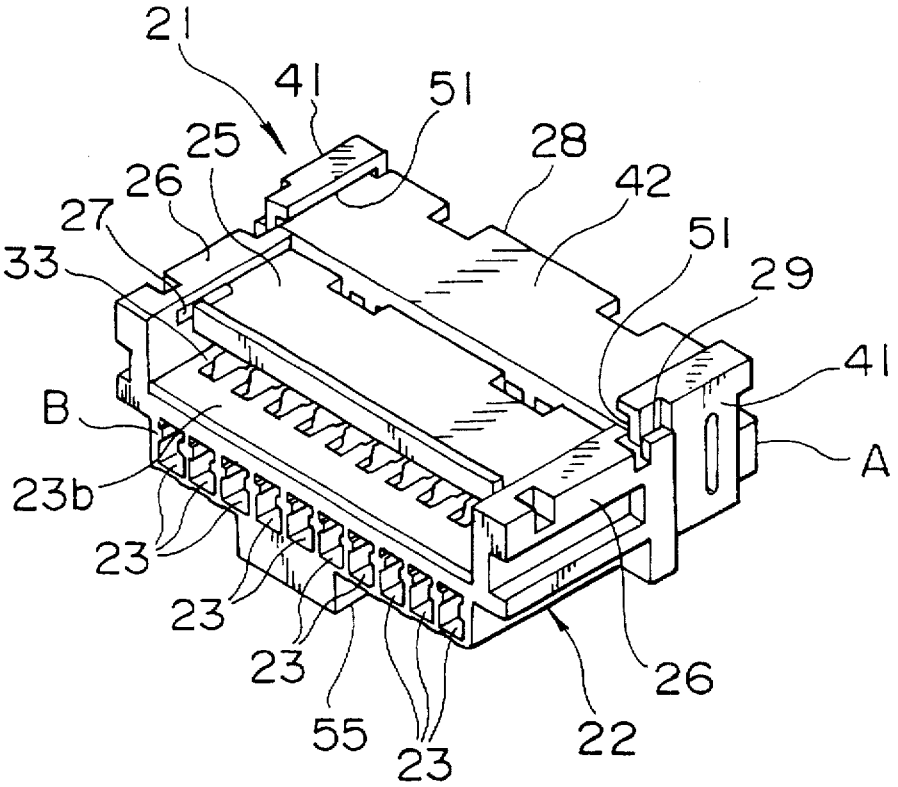
FIG. 2 is a perspective view of the housing.
Figure 3:
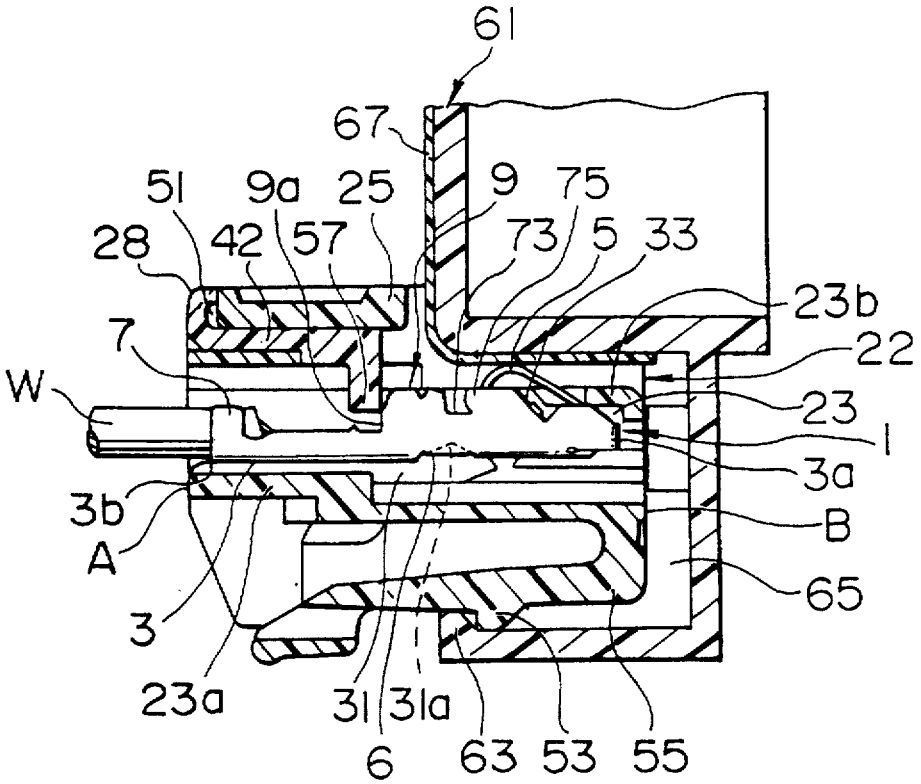
FIG. 3 is a cross sectional view of the connector mounted on the casing.

As shown in FIG. 2, a plastic housing 22 of a connector 21 has a plurality of terminal receiving cavities 23. As shown in FIG. 3, a terminal inlet opening 24 is formed at one side of the terminal receiving cavity 23 (at rear side A in the terminal insertion direction), and the terminal 1 is inserted from a front end of the base plate 3 into the terminal receiving cavity 23. A flexible stopper 31, which has a projection 31*a* at the front end thereof, is arranged on a bottom wall 23*a* of the terminal receiving cavity 23. When the terminal 1 is inserted from the rear side A into the terminal receiving cavity 23, the projection 31*a* is pressed against the base plate 3 of the terminal 1, and the flexible stopper 31 is bent. When the terminal 1 is inserted completely, the projection 31*a* protrudes into the engaging hole 6 of the terminal 1, and the flexible stopper 31 engages with the engaging hole 6. Thereby, the terminal 1 is held at a normal position. In this normal position, the rear end of the terminal 1 is accommodated within the terminal receiving cavity 23. At the other end B (at a front side in the terminal insertion direction) of the housing 22, a top plate 23*b* of the terminal receiving cavity 23 has a cut out 33 through which the terminal receiving cavity 23 opens partially and from which the contact piece 5 is exposed.

As illustrated in FIG. 2, a cover 25 and the retainer 28, which are both made of plastic material, are fitted to the housing 22. At the insides of a pair of side plates 26, the housing 22 has a pair of slide grooves 27 facing each other. The cover 25 is slidably supported by the slide grooves 27. At both outer sides of the rear side A in the insertion direction of the terminal, the housing 22 has grooves 29 which are engaged with a pair of side plates 41*b* of the retainer 28 and which extend substantially perpendicularly to a insertion direction of the terminal. Therefore, the retainer 28 can slide along the grooves 29. In other words, the insertion direction of the terminal 1 and a direction along which the retainer 28 moves intersects substantially perpendicularly. In addition, as shown in FIGS. 4 and 5A, a pair of provisional engaging projections 43 and a pair of primary engaging projections 45 are protruded into the grooves 29.

Figure 4:
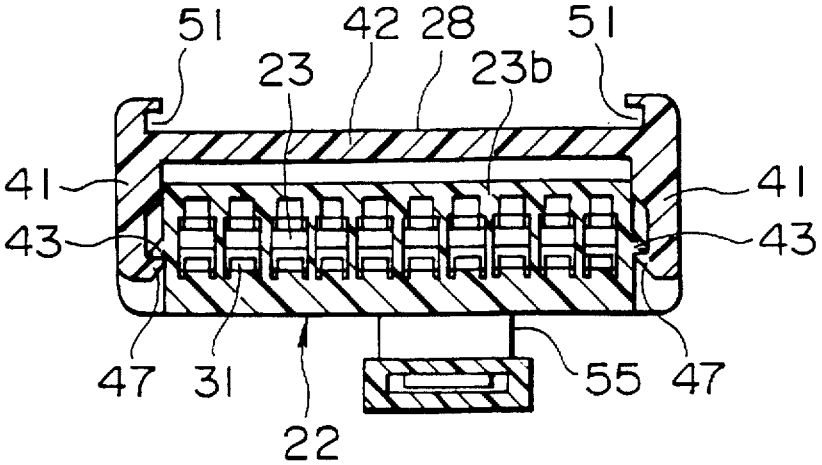
FIG. 4 is a front sectional view of the housing with the retainer being lock at a provisional locking position.
Figure 5A:
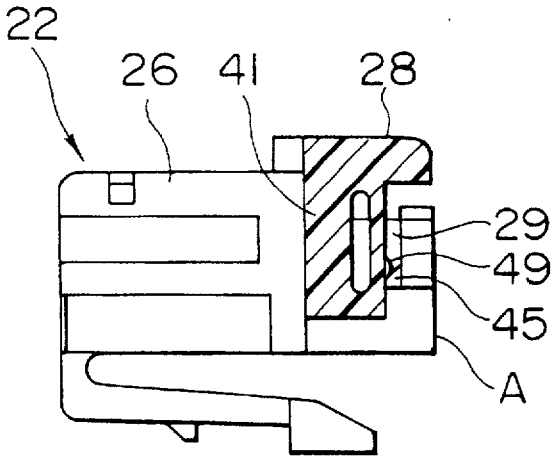
FIGS. 5A and 5B are cross sectional views of the essential parts of the housing each show provisionally locked condition and a permanently locked condition, respectively.
Figure 5B:
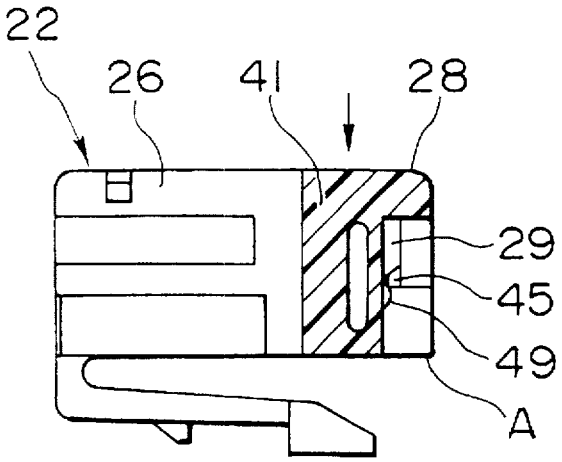

As shown in FIG. 4, the retainer 28 has a H-shaped cross section with the side plates 41 being arranged at both ends of a horizontal plate 42, and can slide as mentioned above. As shown in FIGS. 4, 5A and 5B, the retainer 28 has provisional locking projections 47 and primary locking projections 49 provided at inner sides of distal ends shown as lower ends in the drawings, of the pair of side plates 41 and at the rear side A in the terminal insertion direction, respectively. The provisional locking projections 47 and the primary locking projections 49 engage with provisional engaging projections 43 and primary engaging projections 45, respectively for locating the retainer 28 at a provisionally locked position (shown in FIGS. 2, 4 and 5A) and at a primary locked position (shown in FIGS. 3 and 5B).

As shown in FIG. 2, upper ends in the drawing of the side plates 41 forming a part of the retainer 28 have grooves 51 arranged at the inside thereof for moving the cover. The front side B of the horizontal plate 42 has the detecting protrusion 57 projecting into the terminal receiving cavity 23, as shown in FIG. 3. The upper wall 13 of the projecting portion 9 of the terminal 1 is arranged such that it allows the retainer to be moved to the primary locking position by slipping off from a moving path of the detecting protrusion 57 toward the front side B, when the retainer 28 is at the provisional locking position and the terminal 1 is completely inserted at the normal position in the terminal receiving cavity 23, and which prevent the retainer 28 from moving to the primary locking position by abutting against the detecting protrusion 57 when the terminal 1 is incompletely inserted just before the normal position. The end edge 9*a* of the projecting portion 9 at the rear side A in the terminal insertion direction is designed such that it contacts the detecting protrusion 57 when the terminal 1 is completely inserted and the retainer 28 is locked at the primary locking position.

The grooves 51 in the retainer 28 for moving the cover are designed such that the grooves are positioned coaxially with the slide groove 27 of the housing 22 when the retainer 28 is located at the primary locking position, and the grooves 51 form a step with the slide groove 27 when the retainer 28 is located at the provisional position, as shown in FIG. 2.

As shown in FIG. 3, on an outer surface opposite with the cover 25, the housing 22 is provided with a flexible locking arm 55 having a locking projection 53. A mating casing 61 has an engaging projection 63 which projects into a receiving cavity 65 and is engagable against the locking projection 53 when the housing 22 is inserted into the receiving cavity 65. A printed circuit board 67 arranged on the casing 61 has an end portion inserted into the receiving cavity 65. When the connector 21 is fitted in the receiving cavity 65, the exposed contact pieces 5 of the terminals 1 are electrically connected to the printed circuit board 67.

Next, a function of the connector will be described hereinbelow.

For receiving and holding the terminal 1 in the housing 22, the retainer 28 is locked at the provisional locking position, and the terminal 1 is inserted into the terminal receiving cavity 23 from its front end while the end adjacent to the contact piece 5 is directed toward the cut out 33. When the terminal 1 is inserted completely, the engaging hole 6 of the terminal 1 engages with the flexible locking piece 31, thereby the terminal 1 is prevented from being withdrawn toward the rear direction A. The terminal 1 is received and held in the terminal receiving cavity 23.

Figure 7:
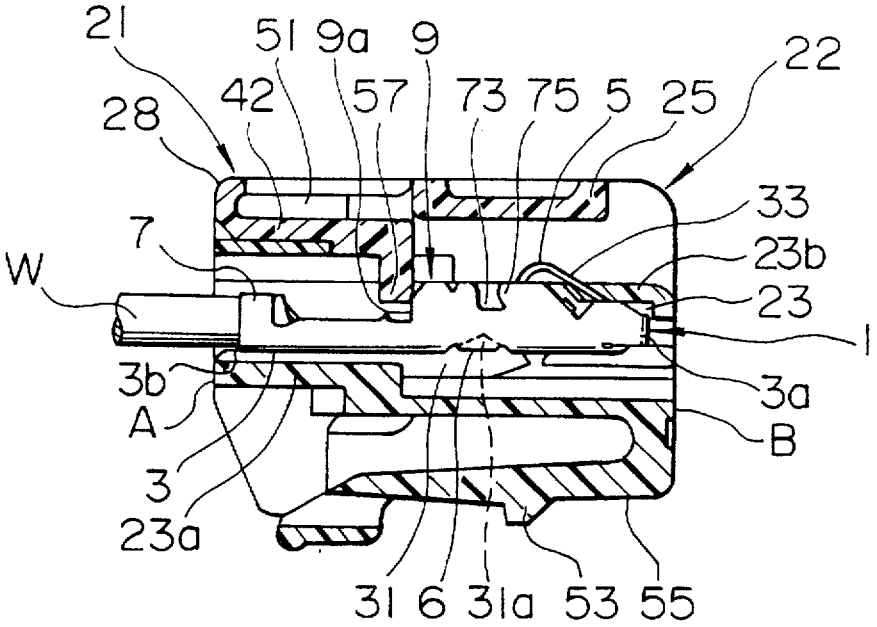
FIG. 7 is a cross sectional view showing a condition in which terminals are inserted completely at the normal position with the retainer being locked at the provisional locking position and then the retainer is moved to the primary locking position.
Figure 8:
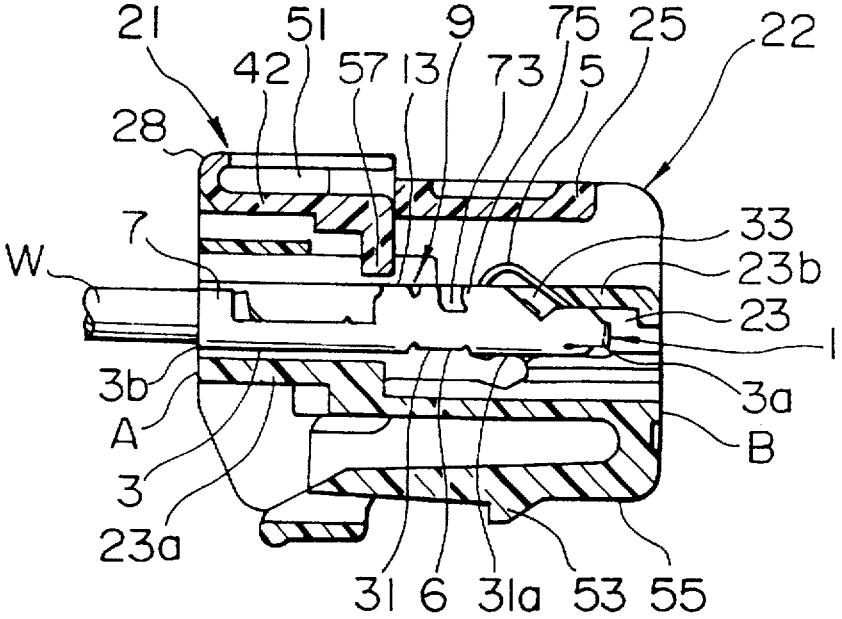
FIG. 8 is a cross sectional view showing a condition in which terminals are inserted partially with the retainer being locked at the provisional locking position and then the retainer is moved to the primary locking position.

Fitting operation of the terminal 1 is completed when the retainer 28 is moved into the primary locking position and is locked at this position, as shown in FIG. 7.

When the retainer 28 is moved into the primary locking position, the primary locking projection 49 of the retainer 28 extends over the primary engaging projection 45, as shown in FIG. 5B, and the retainer 28 is locked at this position. In such a state, the grooves 51 in the retainer 28 for moving the cover and the slide grooves 27 are arranged on the same axis, and the detecting protrusion 57 of the retainer 28 abuts the end edge 9*a* of the projecting portion 9 of the terminal 1. As a result, the terminal 1 is prevented from being withdrawn from the housing 22 in the direction towards the rear side A. Although the projecting portion 9 is weakened by the presence of the detection hole 73, the end edge 9*a* of the projecting portion 9 is unlikely to be deformed since the reinforcing portion 77 is provided at the end edge 9*a* of the projecting portion 9. Therefore, the prevention of the terminal 1 from being withdrawn is ensured by keeping the shape of the projecting portion 9, even when the terminal 1 is pulled strongly toward the rear side A.

Now, assembly of the connector 21 is completed. To mount the connector 21 on the casing 61, the cover 25 is slid along the grooves 51 in the retainer 28, thereby, the upper portion of the cut out 33 is opened. Thereafter, the housing 22 is inserted, while observing the contact piece 5 of each terminals 1.

Figure 6:
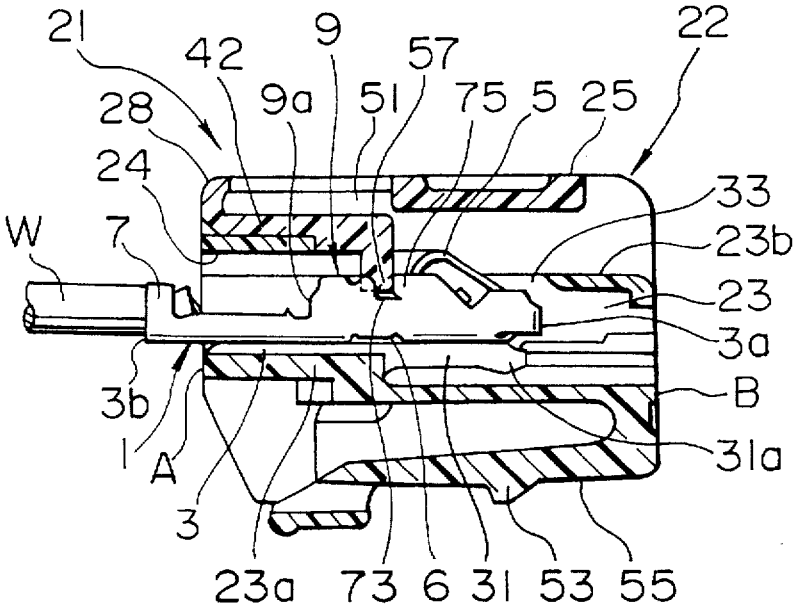
FIG. 6 is a cross sectional view showing a condition in which terminals are inserted with the retainer being locked at the provisional locking position.

As shown in FIG. 6, if the terminal 1 is improperly inserted into the casing 22 with the retainer 28 locked at the primary locking position, the detection hole 73 in the terminal 1 engages with the detecting protrusion 57 in the retainer 28 to prevent the terminal 1 from being inserted further when the detection hole 73 is aligned with the detecting protrusion 57. As the detection hole 73 and the detecting protrusion 57 designed such that they engage each other at the position where the connecting portion 7 is exposed by a predetermined amount, it is ensured that the terminal 1 stops at that position for detecting the improper insertion at sight. Accordingly, if the terminal 1 is inserted falsely, such a falsely insertion is detected easily, certainly and immediately for trying an insertion again.

Since the contact piece protecting portion 75 is provided between the detection hole 73 and the contact piece 5, a pulling force exerted on the terminal 1, which is improperly inserted with the detection hole 73 being engaged with the detecting protrusion 57, acts on the contact piece protecting portion 75, with the result that the detecting protrusion 57 does not press the contact piece 5. Therefore, the contact piece 5 is certainly prevented from being deformed.

The contact piece protecting portion 75 operates similarly, when a foreign substance is entrained to the detection hole 73 before the terminal 1 is inserted. When the terminal 1 is pulled by a strong force, the force acts on the contact piece protecting portion 75, and the contact piece 5 will not be pressed by the foreign substance. Thus, the contact piece 5 is certainly prevented from being deformed.

When the terminal 1 is inserted incompletely, the retainer 28 is prevented from moving to the primary locking position from the provisional locking position, in spite of efforts to move the retainer 28 in this way, because the detecting protrusion 57 would abut the upper wall 13 of the projecting portion 9 of the terminal 1. In this state, a step is formed between the grooves 51 in the retainer 28 and the slide grooves 27 in the housing so that cover 25 can not move towards the retainer 28, with the result that an easy detection of the incompletely inserted terminal 1 is ensured.

What is claimed is:

1. An engaging structure of a terminal and a connector housing comprising:

a housing including a terminal receiving cavity;

the terminal including a base plate, a contact piece formed at a front end portion of the base plate, and an electric wire connecting portion formed at a rear end portion of the base plate, the terminal being inserted into the terminal receiving cavity from the front end of the base plate; and a retainer being movable along a direction intersecting a direction of inserting the terminal into the terminal receiving cavity between a provisional locking position and a primary locking position and being allowed to be locked at these positions, the retainer having a detecting protrusion protruded into the terminal receiving cavity;

the terminal being provided with a projecting portion for moving the retainer to the primary locking position by slipping off from a moving path of the detecting protrusion toward the front side of a terminal insertion direction when the retainer is at the provisional locking position and the terminal is completely inserted at a normal position, and said projecting portion prevents the retainer from moving to the primary locking position by abutting against the detecting protrusion when the terminal is incompletely inserted just before the normal position, wherein said projecting portion is provided with a detection hole which is formed between said contact piece and an end edge of said projecting portion and which is engageable with the detecting protrusion as the terminal moves toward said normal position when the terminal is inserted into the housing where the retainer is located at the primary locking position, and wherein a protecting portion for protecting the contact piece is arranged between the detection hole and the contact piece.

2. The engaging structure of the terminal and the connector housing according to claim 1, wherein a reinforcing portion is arranged at said end edge of said projecting portion in a rear side along said terminal insertion direction, for reinforcing the projecting portion.

3. An engaging structure of a terminal and a connector housing comprising:

a housing including a terminal receiving cavity;

the terminal including a base plate, a contact piece formed at a front end portion of the base plate, and an electric wire connecting portion formed at a rear end portion of the base plate, the terminal being inserted into the terminal receiving cavity from the front end of the base plate; and a retainer being movable along a direction intersecting a direction of inserting the terminal into the terminal receiving cavity between a provisional locking position and a primary locking position and being allowed to be locked at these positions, the retainer having a detecting protrusion protruded into the terminal receiving cavity;

the terminal being provided with a projecting portion for moving the retainer to the primary locking position by slipping off from a moving path of the detecting protrusion toward the front side of a terminal insertion direction when the retainer is at the provisional locking position and the terminal is completely inserted at a normal position, and said projecting portion prevents the retainer from moving to the primary locking position by abutting against the detecting protrusion when the terminal is incompletely inserted just before the normal position, said projecting portion having a detection hole which is formed between said contact piece and an end edge of said projecting portion and which is engageable with the detecting protrusion as the terminal moves toward said normal position when the terminal is inserted into the housing where the retainer is located at the primary locking position, wherein a reinforcing portion is arranged at said end edge of said projecting portion in a rear side along said terminal insertion direction, for reinforcing the projecting portion.

* * * * *